United States Patent [19]

Wilson et al.

[11] Patent Number: 4,696,413

[45] Date of Patent: Sep. 29, 1987

[54] VENDING SYSTEM AND METHOD FOR PREVENTING MULTIPLE PRODUCT VENDS

[75] Inventors: Aaron W. Wilson, Boise, Id.; Richard A. Pollock, Fresno, Calif.

[73] Assignee: The Vendo Company, Fresno, Calif.

[21] Appl. No.: 819,223

[22] Filed: Jan. 15, 1986

[51] Int. Cl.[4] ..... G07F 11/00

[52] U.S. Cl. ..... 221/13; 221/15; 221/125; 194/241

[58] Field of Search ..... 221/9, 13, 125, 129, 221/15; 194/240, 241, 242; 361/193; 307/514, 515, 516; 328/129.1, 130.1, 134

[56] References Cited

U.S. PATENT DOCUMENTS

| | | | |
|---|---|---|---|
| 3,232,400 | 2/1966 | Hendrickson | 221/129 X |
| 3,349,881 | 10/1967 | Camp | 221/125 X |
| 3,691,431 | 9/1972 | Hendrickson et al. | 221/125 X |
| 4,044,877 | 8/1977 | Burton | 221/125 X |
| 4,220,235 | 9/1980 | Lindsey et al. | 194/240 |

*Primary Examiner*—Joseph J. Rolla
*Assistant Examiner*—Edward S. Ammeen
*Attorney, Agent, or Firm*—Flehr, Hohbach, Test, Albritton & Herbert

[57] ABSTRACT

System and method for preventing multiple vends in which a customer gets more than one product for the price of one. The invention is applicable to vending machines having separate vend motors for delivering different products, with product selection switches for selectively energizing the vend motors. When one of the vend motors is energized, energization of a second vend motor is inhibited for a predetermined period of time to prevent vending of a second product.

17 Claims, 2 Drawing Figures

21
TIMER
56
57
+V
53
49
52
51
41
43
44
42
46
37
47
31
36
26
27
28
29
L2
L1
33
34
23
24
58
59
FROM VEND ENABLE CIRCUIT 16
TO SWITCHES 13

VENDING SYSTEM AND METHOD FOR PREVENTING MULTIPLE PRODUCT VENDS

This invention pertains generally to vending machines, and more particularly to a vending system and method for preventing multiple vends in which a customer gets more than one product for the price of one.

With some vending machines, it is possible for a customer to get two products for the price of one by manipulating two product selection buttons while the machine is in the selection mode. Such machines generally have separate vend motors for delivering different products, with switches actuated by the selection buttons for selectively energizing the motors during the initial phase of a vend cycle. After the motors have traveled a short distance, secondary switches are actuated to supply operating current to the motors for the remainder of the vend cycle. If a product selection button is released or a motor is otherwise de-energized before the secondary switch is actuated, the inertia of the motor may cause it to continue moving to the point that the secondary switch is actuated to conclude the vend cycle. If a second selection button is pushed before the secondary switch associated with the first button is actuated, the vend motor associated with the second button will also be energized, causing a second product to be delivered. With other vending machines, the pressing of the second button determines the product which will be vended to the next customer, rather than producing a double vend. When the next customer deposits his coinage into the machine, he receives the product selected by the second button pushed by the first customer, rather than having the opportunity to select his own product.

It is in general an object of the invention to provide a new and improved vending system and method which prevent multiple product vends.

Another object of the invention is to provide a system and method of the above character in which energization of a second vend motor is inhibited for a predetermined period of time after a first product selection switch is actuated.

Another object of the invention is to provide a system and method of the above character which can be incorporated readily into existing vending machines.

These and other objects are achieved in accordance with the invention by providing a vending machine with a plurality of electrically energized vend motors for delivering products during a vend operation, product selection switches connected to the vend motors for selectively energizing the motors to initiate a vend operation, means active upon the initial energization of a vend motor for maintaining the motor in an energized condition to complete the vend operation, means for monitoring the energization current applied to the vend motors by the product selection switches, and means for inhibiting energization of the vend motors through the switches for a predetermined period of time after a change in the energization current to prevent a second motor from being energized while a first motor is still in motion.

Figure 1:
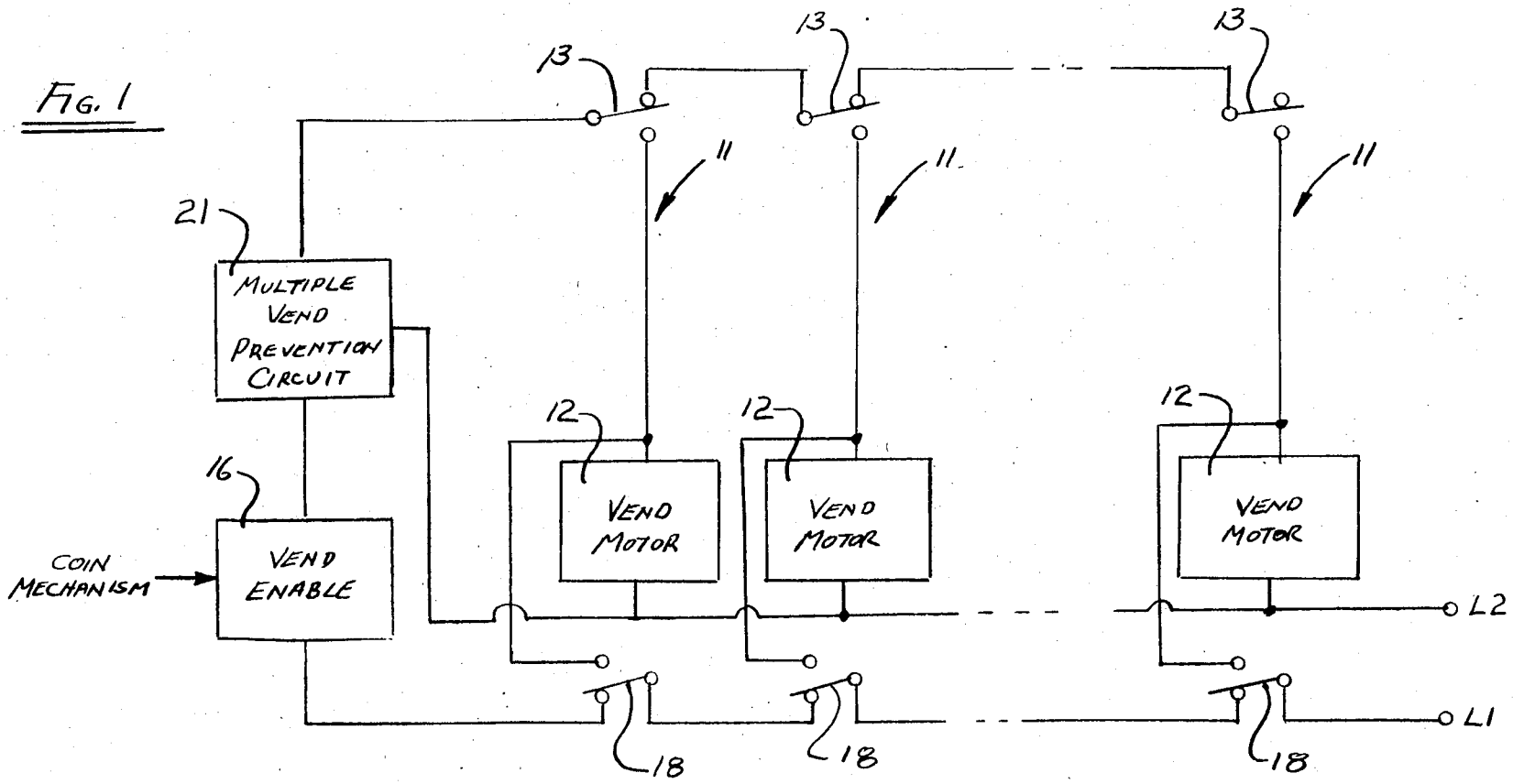
FIG. 1 is a simplified block diagram illustrating the use of the invention in connection with a prior art vending machine.

In the drawings, the invention is illustrated in connection with the vend control section of a prior art vending machine having a plurality of product delivery channels 11 for vending different products to a customer. Each of the product delivery channels includes an electrically energized vend motor 12 and a product selection switch 13 for energizing the vend motor to initiate a vend cycle. During the vend cycle, the vend motor actuates the vending mechanism (not shown) to deliver a product from a stack or other storage area within the machine to a delivery chute or other area which is accessible to the customer.

Each of the product selection switches 13 is a single pole, double throw push button actuated switch having normally closed and normally open contacts. The normally closed contacts of these switches are connected electrically in series in an alternating current power circuit, with each switch receiving power through the normally closed contacts of the preceding switches in the circuit. Power from line conductor L1 is applied to the switches by a vend enable circuit 16 to place the machine in a selection mode upon receipt of proper coinage in the coin mechanism. The normally open contacts of each switch are connected to one side of the corresponding vend motor, and the other sides of the motors are connected to line conductor L2.

Cam-operated switches 18 disable the product selection switches and supply operating power directly to the vend motors once a vend cycle has begun. These switches are single pole, double throw switches which are actuated by cams driven by the vend motors. The normally closed contacts of these switches are connected electrically in series between L1 and the vend enable circuit, and the normally open contacts are connected to the same sides of the motors as the normally open contacts of the product selection switches.

When the machine is in the selection mode and one of the product selection switches is actuated, operating current is applied to the vend motor associated with that switch and the vend motor starts to turn to initiate a vend cycle. After the motor turns a short distance, the cam-operated switch driven by the motor is actuated to remove power from the vend enable circuit and connect the motor directly to the power source conductors for the remainder of the vend cycle. Upon completion of the vend cycle, the cam-operated switch de-energizes the motor and reconnects line conductor L1 to the vend enable circuit. If the product selection switch is released before the initial actuation of the cam-operated switch, the vend motor may or may not continue turning to the point that the cam-operated switch is actuated, depending upon the inertia of the motor, the position of the motor when the selection switch is released, and the effectiveness of the motor brake. If the cam-operated switch is not actuated, the customer can press another button to initiate a vend cycle for the product selected by that button.

If a second product selection button is pushed before the cam-operated switch associated with the first selection switch is actuated, a double vend can result if the vend motors actuated by the two selection switches both turn far enough to actuate the cam-operated switches. If this happens, the customer will receive two products for the price of one. To prevent these undesired multiple vends from occurring, a circuit 21 is connected to the power circuit for the product selection switches to inhibit energization of a second vend motor through the selection switches.

Figure 2:
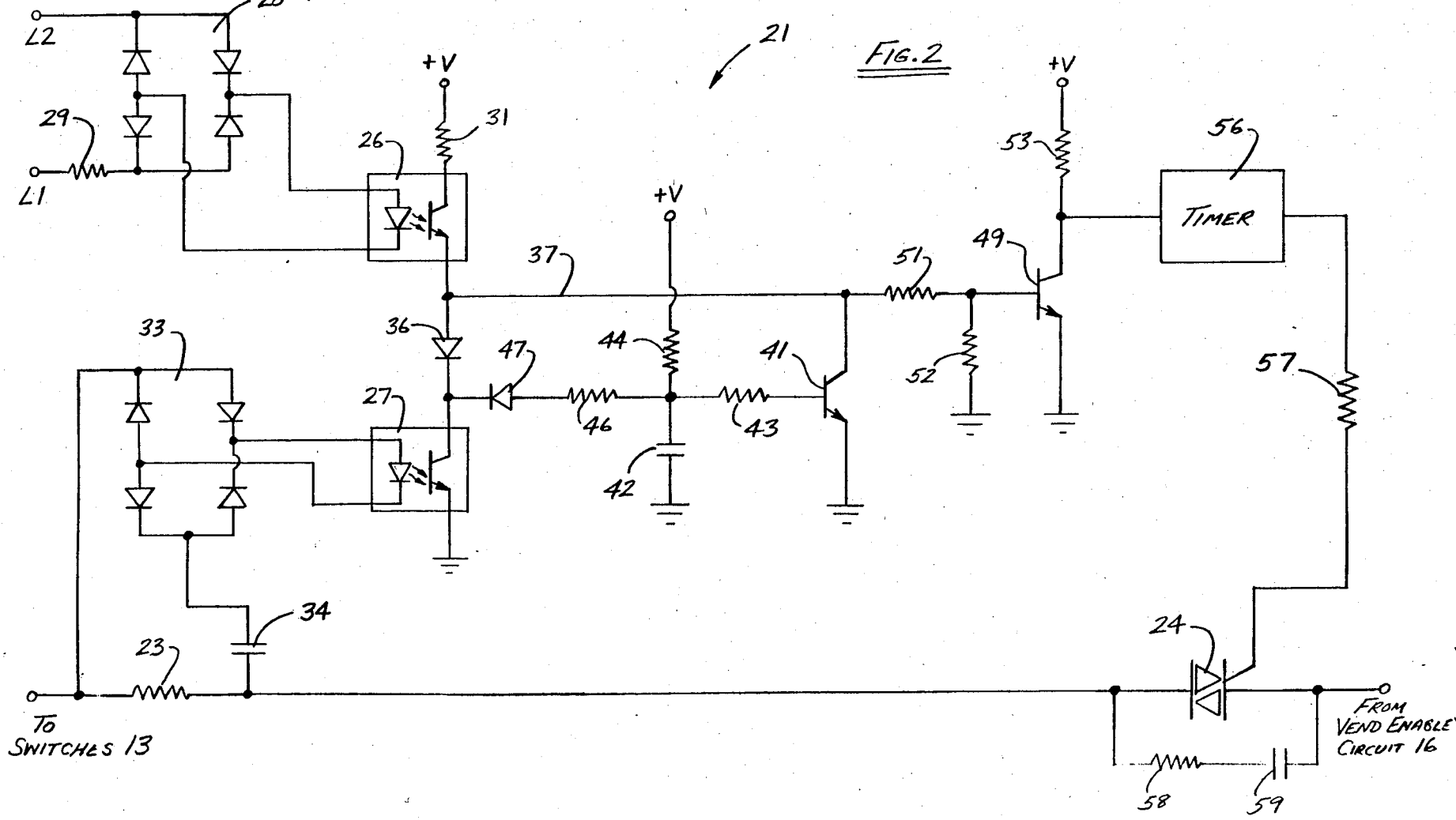
FIG. 2 is a circuit diagram, partly in block form, of one embodiment of a system according to the invention for preventing multiple product vends from a machine of the type illustrated in FIG. 1.

As illustrated in FIG. 2, the circuit for preventing multiple vends includes a sensing resistor 23 and a triac 24 which are connected in series with the power circuit for the selector switches. In FIG. 1, circuit 21 is connected between the vend enable circuit 16 and the product selection switches, but it can be connected in any portion of the circuit through which the initial energization curent for the motor flows. As discussed more fully hereinafter, triac 24 is normally maintained in a conductive state so that current for energizing the vend motors will be available to the product selection switches when the machine is in the selection mode. Circuit 21 includes current source 26 and a current sink 27, each of which comprises an electro-optical coupler having a light emitting diode (LED) and a phototransistor.

Current source 26 is driven or controlled by a reference signal provided by a rectifier bridge 28 connected to line conductors L1 and L2 through a current limiting resistor 29. The reference signal is in phase with the line current, and the output of the rectifiers is connected to the LED in the current source. The collector of the phototransistor is connected to a voltage source +V by a resistor 31, and the output of the source is taken at the emitter of the phototransistor. With the polarities indicated and no load applied to the source, the source produces an output signal having a DC level equal to the source voltage, with negative going pulses or spikes at the zero crossings of the line current.

Current sink 27 is driven or controlled by a reference signal which is developed across sensing resistor 23. This signal has an amplitude and phase corresponding to the amplitude and phase of the energization current flowing through the resistor. The vend motors constitute an inductive load which changes with the speed of the motors, and this causes the phases of the energization current and the input signal to vary with the motor speed.

The input signal is applied to a rectifier bridge 33 through a phase shifting network consisting of a capacitor 34. The value of the capacitor is selected such that the input signal is in phase with the line current and the reference signal when one of the vend motors is operating at its normal speed. The output of bridge 33 is connected to the LED in the current sink. Input current is applied to the collector of the phototransistor, and the emitter of the phototransistor is connected to ground. When energization current is flowing through the product selection switches, the current sink is maintained in a conductive state except at the zero crossings of the energization current.

The output of current source 26 is connected to the input of current sink 27 by a diode 36 and to an output line 37. When an energization current is flowing in the selection switch circuit, the current sink conducts and maintains the output signal on line 37 at a low level. In the event of an interruption in the energization current, the current sink stops conducting and the output signal becomes high. With the current sink operating in phase with the current source, zero crossings in the energization current do not produce changes in the output signal.

Means is provided for preventing a change in the level of the signal on output line 37 until the vend motors are operating at their normal speed. This prevents a change in level which might otherwise occur upon a zero crossing before the current source and current sink are operating in phase with each other. This means includes a transistor 41 connected between the output line and ground. The conductivity of this transistor is controlled by the charge on a capacitor 42 which is connected to the base of the transistor by a resistor 43. Charging current is supplied to the capacitor from source +V through a resistor 44 to maintain the capacitor in a normally charged condition. The capacitor is discharged through the current sink, and a resistor 46 and a diode 47 are connected between the capacitor and the input of the current sink for this purpose. When the capacitor is charged, transistor 42 holds output line 37 at the low level. When the current sink is turned on and the capacitor is discharged to the point that the transistor stops conducting, line 37 is no longer clamped at the low level, and it will become high if the current sink stops conducting. The values of capacitor 42 and resistor 46 are chosen such that the vend motors can reach their normal operating speed before transistor 41 is turned off.

Means is provided for inhibiting energization of the vend motors in response to the output signal on line 37. This means includes a transistor 49 to which the output signal is applied by a resistor 51 connected between the output line and the base of the transistor. This transistor has a base resistor 52, a collector resistor 53, and its emitter is grounded.

Transistor 49 controls the operation of a timer 56 which has a control input connected to the collector of the transistor. In one presently preferred embodiment, the timer comprises a level triggered one-shot multiple vibrator having an active period of 2.2 seconds.

The output of timer 56 is connected to the control gate of triac 24 through resistor 57. A resistor 58 and a capacitor 59 are connected across the terminals of the triac to suppress transients.

Operation and use of the vending system, and therein the method of the invention, are as follows. When the machine is placed in the selection mode by the deposit of proper coinage, product selection switches 13 receive power through vend enable circuit 16 and triac 24. As long as none of the vend motors is energized, no current flows in the switch circuit, and current sink 27 is turned off.

Output line 37 is held low by transistor 41, timer 56 is inactive, and triac is held in its conductive state by resistor 57.

When one of the selection switches is actuated, an energization current flows through this switch to the vend motor controlled by the switch. This energization current causes current sink 27 to conduct, discharging capacitor 42 and thereby turning off transistor 41. Thereafter, output line 37 is free to rise in level if the current sink is turned off.

If the customer releases the product selection switch before the actuation of cam-operated switch 18, the energization current will stop, current sink 27 will stop conducting, and the output signal will become high. If a customer presses a second product selection switch while holding the first product selection switch, the energization current is only momentarily interrupted. If this momentary interruption occurs outside of a reference signal zero crossing, the current sink stops conducting and the output signal becomes high. However, if the momentary interruption occurs entirely within the reference signal zero crossing, the second motor start-up causes the current sink phase to be shifted from that of the reference signal. This also results in the output signal becoming high. When the output signal becomes high, transistor 49 turns on, triggering timer 56. While the timer is in its active state, triac 24 is turned off, removing power from the product selection switches and preventing a second vend motor from being energized through these switches. Thus, energization of the motors is inhibited for a time sufficient to prevent a second product from being vended.

When the current sink is turned off, capacitor 42 is charged through resistor 44, turning on transistor 41 to return the output signal to its low level.

When one of the vend motors is operating at its normal speed, the current source and the current sink operate in phase, and zero crossings have no effect on the output signal. Before a motor reaches its normal speed, the current sink is driven out of phase with the current source, but transistor 41 prevents interruptions due to zero crossings in the energization current from affecting the output signal. The system is thus able to discriminate between interruptions caused by actuation of the product selection switches and interruptions due to zero crossings.

It is apparent from the foregoing that a new and improved system and method have been provided for preventing multiple product vends in vending machines. While only certain presently preferred embodiments have been described in detail, as will be apparent to those familiar with the art, certain changes and modifications can be made without departing from the scope of the invention as defined by the following claims.

We claim:

1. In a vending machine: a plurality of product delivery channels each having an electrically energized vend motor for delivering a product during a vend operation, product selection switches connected electrically in series in a power circuit and to the vend motors in respective ones of the product delivery channels for selectively energizing the motors with power from the power circuit to initiate a vend operation, means active upon the initial energization of one of the vend motors for maintaining the motor in an energized condition to complete the vend operation, means for monitoring the current in the power circuit to detect an interruption in the current due to actuation of one of the product selection switches once a first one of the vend motors has been energized, and means responsive to the interruption in the power circuit current for inhibiting energization of a second one of the vend motors for a predetermined period of time.

2. The vending machine of claim 1 wherein the means for inhibiting energization of the second one of the vend motors includes a switching device through which an energizing current for the second motor must pass, means including a timer for rendering the switching device nonconductive for a period of time determined by the timer, and means for actuating the timer in response to the interruption of the current in the power circuit.

3. In a vending machine: a plurality of product distribution channels each having an electrically energized vend motor for delivering a product during a vend operation, a plurality of product selection switches connected electrically in series in an alternating current power circuit in which each of the switches is normally energized through the preceding switches in the circuit, each of said switches also being connected to one of the vend motors and adapted to de-energize the successive switches in the circuit and energize the corresponding one of the vend motors to initiate a vend operation when actuated, means active upon the initial energization of one of the vend motors for maintaining the motor in an energized condition to complete the vend operation, means for providing a reference signal of predetermined phase, means for monitoring the current in the power circuit and providing an input signal having an amplitude and phase corresponding to the amplitude and phase of the power circuit current, said input signal varying in phase with the speed of the vend motors and being in phase with the reference signal when one of the vend motors is operating at its normal speed, means responsive to the input signal and the reference signal for providing an output signal in the event of an interruption in the current in the power circuit when a first one of the vend motors is operating at its normal speed, a timer which is active for a predetermined period of time in response to the output signal, and means responsive to the timer for removing power from the power circuit to prevent energization of a second one of the vend motors for the predetermined period of time.

4. The vending machine of claim 3 wherein the means for providing the output signal includes a current source controlled by the reference signal and a current sink controlled by the input signal, the output of the current source being connected to the input of the current sink and to an output line upon which the output signal appears.

5. The vending machine of claim 4 including means connected to the output line and responsive to the input signal for preventing delivery of the output signal for a period of time after the initial energization of one of the vend motors sufficient to permit the energized motor to reach its normal operating speed and the input signal to be in phase with the reference signal.

6. The vending machine of claim 5 wherein the means for preventing delivery of the output signal includes a capacitor, means for supplying charging current to the capacitor to maintain the capacitor in a normally charged condition, switching means connected to the output line and responsive to the charge on the capacitor for preventing delivery of the output signal when the capacitor is in the charged condition, and means connecting the capacitor to the current sink such that the capacitor is discharged through the current sink when current is flowing in the power circuit.

7. In a vending machine: a plurality of product distribution channels each having an electrically energized vend motor for delivering a product during a vend operation, a plurality of product selection switches connected to respective ones of the vend motors for selectively applying an energizing current to said motors to initiate a vend operation, means active upon the initial energization of one of the vend motors for maintaining the motor in an energized condition to complete the vend operation, means for providing a reference signal of predetermined phase, means for monitoring the motor energization current and providing an input signal having an amplitude and phase corresponding to the amplitude and phase of the energization current, said input signal varying in phase with the speed of the vend motors and being in phase with the reference signal when one of the vend motors is operating at its normal speed, a current source driven by the reference signal to provide an output signal of predetermined level, a current sink rendered conductive by the input signal and connected to the output of the current source for maintaining the output signal at a reference level when the energization current is applied to one of the vend motors, and means responsive to a change in the level of the output signal for inhibiting further energization of the vend motors for a predetermined period of time after interruption of the energization current to one of the motors.

8. The vending machine of claim 7 including switching means connected to the output of the current source for maintaining the output signal at the reference level when in a conductive state, and means including a timing circuit connected to the switching means for switching the switching means to a nonconductive state a predetermined time after the energization current is applied to one of the vend motors, said period of time being sufficient to allow the vend motor to reach its normal operating speed before the switching means switches to the nonconductive state.

9. The vending machine of claim 8 wherein the timing circuit includes a capacitor, means for supplying current to the capacitor to maintain the capacitor in a normally charged condition, means connecting the capacitor to the current sink so that the capacitor is discharged at a predetermined rate through the current sink when the current sink is rendered conductive, and means connecting the capacitor to the switching means so that the state of the switching means is determined by the charge on the capacitor.

10. The vending machine of claim 7 wherein the means for inhibiting energization of the vend motors includes a normally conductive controlled switching element through which the energization current for the motors passes, and means including a timer for holding the switching element in a non conductive state for a predetermined period of time after the change in the level of the output signal.

11. In a method of vending products from a machine having a plurality of electrically energized vend motors for delivering products during a vend operation, product selection switches connected to respective ones of the vend motors for selectively energizing the motors to initiate a vend operation, and means active upon the initial energization of one of the vend motors for maintaining the motor in an energized condition to complete the vend operation, the steps of: monitoring the energization current applied to the vend motors by the product selection switches to detect an interruption in the energization current due to actuation of one of the product selection switches subsequent to the energization of a first vend motor, and inhibiting energization of the vend motors through the switches for a predetermined period of time in response to the interruption of the energization current to prevent a second motor from being energized while the first motor is performing a vend operation.

12. In a method of vending products from a machine having a plurality of electrically energized vend motors for delivering products during a vend operation, product selection switches connected to respective ones of the vend motors for selectively energizing the motors to initiate a vend operation, and means active upon the initial energization of one of the vend motors for maintaining the motor in an energized condition to complete the vend operation, the steps of: monitoring the energization current applied to the vend motors by the product selection switches, providing a reference signal, providing an input signal which corresponds to the energization current, providing an output signal in the event that the input signal changes in a predetermined manner relative to the reference signal, and inhibiting energization of the vend motors for a predetermined period of time in response to the output signal to prevent a second motor from being energized while a first motor is performing a vend operation.

13. The method of claim 12 wherein the reference signal has a predetermined phase, the input signal varies in phase with the speed of the vend motors and is in phase with the reference signal when one of the vend motors is operating at its normal speed, and delivery of the output signal is inhibited until one of the vend motors is operating at its normal speed and the input and reference signals are in phase.

14. The method of claim 12 including the steps of applying the reference signal to a current source to actuate the source in accordance with the reference signal, applying the input signal to a current sink connected to the output of the current source to provide a signal at the output of the current source which varies between first and second levels in accordance with the energization current, and inhibiting energization of the vend motors when the output signal is at the second level.

15. The method of claim 14 including the step of holding the output signal at the first level for a period of time after energization of one of the vend motors sufficient to permit the motor to reach its normal operating speed.

16. In a vending machine: a plurality of product delivery channels each having an electrically energized vend motor for delivering a product during a vend operation, product selection switches connected electrically in series in a power circuit in which each of the switches normally receives power through the preceding switches in the circuit and is adapted for actuation to divert the power from successive switches to a corresponding one of the vend motors to energize the motor to initiate a vend operation, means active upon the initial energization of a first one of the vend motors for maintaining the motor in an energized condition to complete the vend operation, and means responsive to the level and phase of the current in the power circuit for inhibiting energization of a second one of the vend motors for a predetermined period of time after the product selection switch corresponding to the first one of the vend motors is actuated.

17. In a vending machine: a plurality of product delivery channels each having an electrically energized vend motor for delivering a product during a vend operation, product selection switches connected electrically in series in a power circuit in which each of the switches normally receives the power through the preceding switches in the circuit and is adapted for actuation to divert the power from successive switches to a corresponding one of the vend motors to energize the motor to initiate a vend operation, means active upon the initial energization of a first one of the vend motors for maintaining the motor in an energized condition to complete the vend operation, and means responsive to an interruption of the current in the power circuit for inhibiting energization of a second one of the end motors for a predetermined period of time after the product selection switch corresponding to the first one of the vend motors is actuated, the means responsive to the interruption of the current in the power circuit including means for distinguishing between an interruption of current produced by actuation of one of the product selection switches and a periodic zero crossing of an alternating current in the power circuit.

* * * * *